United States Patent [19]

Nezworski

[11] Patent Number: 4,825,887

[45] Date of Patent: May 2, 1989

[54] GLASS WASHER SPRAY DISCHARGE AND CONTROL MEANS

[75] Inventor: James E. Nezworski, Waukesha, Wis.

[73] Assignee: Perlick Corporation, Milwaukee, Wis.

[21] Appl. No.: 158,665

[22] Filed: Feb. 22, 1988

[51] Int. Cl.[4] ..... B08B 3/02

[52] U.S. Cl. ..... 134/183; 134/199

[58] Field of Search ..... 134/80, 148, 153, 154, 134/182, 183, 199, 200; 4/662

[56] References Cited

U.S. PATENT DOCUMENTS

| | | | |
|---|---|---|---|
| 1,223,261 | 4/1917 | Critchlow | 134/182 |
| 1,634,215 | 6/1927 | Rosenfeld | 134/182 X |
| 2,766,764 | 10/1956 | Bennett | 134/154 X |
| 4,420,003 | 12/1983 | Lee et al. | 134/183 X |

FOREIGN PATENT DOCUMENTS

| | | | |
|---|---|---|---|
| 1512498 | 1/1968 | France | 134/182 |
| 473349 | 10/1937 | United Kingdom | 134/182 |
| 624800 | 6/1949 | United Kingdom | 134/182 |

*Primary Examiner*—Philip R. Coe

*Attorney, Agent, or Firm*—James E. Nilles; James R. Custin

[57] ABSTRACT

In the disclosed glass washing machine each spray curtain comprises a vertically slitted sheet of supple plastic and a similarly slitted guard sheet of a stiffer but flexible smooth-surface plastic. The guard sheet extends down through about the upper half of the height of the supple sheet and overlies its side from which glasses approach it, prolonging the life of the supple sheet by decreasing rubbing and sharp flexing due to passing glasses. A grid of vertical slats closely underlies the top wall in each cleansing zone, causing upwardly sprayed liquid to fall from it in numerous uniformly distributed streams that are effective in cleansing exterior surfaces of glasses. Each spray nozzle assembly is removable without tools by loosening one wing nut and pulling out of the assembly a male fitting on a hose that communicates the assembly with another part of the machine.

3 Claims, 5 Drawing Sheets

GLASS WASHER SPRAY DISCHARGE AND CONTROL MEANS

FIELD OF THE INVENTION

This invention relates to machines for washing beverage glasses and similar articles, comprising a carrier that moves in one direction to transport the articles through a plurality of zones and a set of nozzles in each of certain of those zones from which cleansing liquid is sprayed against the articles; and the invention is more particularly concerned with improved means in such a machine for discharging and controlling spray to ensure that every article on the carrier will be subjected to complete and intense flushing with liquid from each set of nozzles and that liquid discharged from each set of nozzles is substantially confined to the zone in which that set of nozzles is located.

RELATED PATENT APPLICATIONS

The applicant's copending application, Ser. No. 117,155, filed Oct. 30, 1987, discloses a high capacity glass washing machine of the general type to which the present invention relates. Another such machine, more compact and of somewhat smaller capacity, is disclosed in the applicant's copending application, Ser. No. 136,133, filed Dec. 21, 1987. The applicant's copending application, Ser. No. 145,623, filed Jan. 19, 1988, discloses means for quickly and substantially automatically cleaning and deliming the spray nozzles of such glass washing machines. All of these applications have a common assignee with this one.

BACKGROUND OF THE INVENTION

One type of glass washing invention to which the present invention is applicable, disclosed in the abovementioned Ser. No. 117,155, has a carrier that moves linearly to carry glasses from a loading zone at one end of the machine, through successive cleansing zones, to an unloading zone at the other end of the machine. Another type, disclosed in Ser. No. 136,133, has a rotary carrier whereon glasses are carried orbitally from an access zone at which glasses are loaded onto the carrier and removed from it, through cleansing zones, and back to the access zone. In each of these machines, the carrier transports the glasses slowly through one cleansing zone in which they are subjected to sprays of detergent solution discharged from washing nozzles and then through another cleansing zone in which they are subjected to sprays of germicidal rinsing solution discharged from rinsing nozzles.

A basic problem common to all glass washing machines of the general type here under consideration is to prevent substantial mixing of the germicidal solution discharged in the rinsing zone with the detergent solution discharged in the washing zone, notwithstanding that the two solutions are being sprayed simultaneously in adjacent cleansing zones whenever the machine is in operation. The detergent solution must be of a nonfoaming type, since the sprayed detergent solution is collected in a retention tank and pumped back to the washing nozzles by means of a centrifugal-type recirculation pump, and foaming of the solution would obviously impair the recirculation process. However, the most commonly used germicidal solution is one that tends to promote vigorous foaming of the detergent solution if mixed with the latter in any substantial proportion. Fortunately, no substantial foaming occurs if only a small proportion of either solution is mixed with the other.

For substantially confining each type of solution to the cleansing zone in which it is discharged, while nevertheless permitting beverage glasses to pass freely from one to the other of these zones, it has been conventional to suspend a vertically slitted waterproof curtain between the two zones, as disclosed in U.S. Pat. No. 3,878,856. A generally similar curtain is hung between a cleansing zone of the machine and an adjacent access zone in which glasses are loaded into the machine and/or unloaded from it. The material now used for such curtains in most commercial glass washing machines is a very supple slitted sheet of specially compounded polyvinyl chloride embossed with a pattern of diamond-shaped nubs on one of its surfaces and with a textile-weave type of pattern on its opposite surface. The slits in this sheet, which extend through most of its height from its bottom edge, define in it numerous narrow strips that permit passage through it of articles being washed, and its embossed surface patterns tend to prevent these strips from curling so that they cooperate to provide a normally straight-hanging spray barrier.

While otherwise satisfactory, this conventional curtain has an undesirably short service life. It has been found that the textured surfaces of the curtain material are to a substantial extent responsible for its relatively poor durability. When a glass or similar article engages against one of the strips defined by the slits in the curtain, there is friction between the article and the textured surface of the strip. This friction is particularly high when the strip is first engaged by a tall article such as a pitcher, which contacts the strip near its top, leaving a substantial length of strip hanging below the zone of contact whereby the engaged portion of the strip is loaded for rubbing force and is sharply flexed by the article. Because of the high temperature of the detergent solution and the leaching action of both solutions, the curtain material gradually loses its suppleness in the course of service, and its strips then begin to break off near their top ends as a result of repeated frictional and flexing engagements with articles being washed. While the gradual embrittlement of such a curtain cannot be prevented, the present invention is based upon a recognition that its useful life can be substantially prolonged by minimizing friction between it and the articles passing through it and by preventing it from being sharply flexed by the passing articles.

The cleansing effectiveness of a glass washer is directly dependent upon a complete and intensive spraying of each of the cleansing liquids against both the inner and the outer surfaces of every glass. Since glasses rest upside down on the carrier, their interior surfaces are sprayed by upwardly discharging nozzles mounted beneath the carrier, and their exterior surfaces are sprayed by downwardly discharging nozzles mounted at a substantial distance above the carrier.

When upwardly sprayed liquid discharged from the lower nozzles impinges the inner surface of the side wall of a glass, it flows upwardly along that surface towards or to the bottom of the glass, and then again follows the inner side surface of the glass as it streams back down. Similarly, upwardly directed spray that enters the glass but does not impinge its sides strikes the inner bottom surface of the glass, clings to it in flow towards the side surface, and then flows down along the interior of the side wall. The interior surface of every glass is thus subjected to intense washing by upwardly directed spray that enters the circle defined by the rim of the glass.

By contrast, spray discharged from an upper nozzle, insofar as it does not fall through spaces between glasses, merely streams down the exterior surface of glasses and therefore, quantity-for-quantity, provides less effective cleaning action than upwardly discharged spray. The significance of this is that a user's lips normally contact only the exterior surface of a glass, leaving on it germs and possibly lipstick or the like that can be removed only with thorough and intensive flushing. The present invention is based in part upon a recognition that, contrary to what obvious considerations would suggest, a substantial portion of the upwardly directed spray discharged from lower nozzles in a glass washing machine can be applied to cleaning the exterior surfaces of glasses, thus materially supplementing the effects of the spray discharged from the upper nozzles.

As pointed out in the above-mentioned Ser. No. 145623, a glass washing machine cannot operate satisfactorily if its spray nozzles are blocked to any substantial extent. That application discloses means for substantially automatic cleaning and deliming of nozzles while the nozzle assemblies remain in place on the machine. Applicable sanitary standards do not require that the nozzle assemblies of a glass washer be removable if they can be easily cleaned while in place. However, such standards require that all splash contact surfaces be readily cleanable; and since every nozzle assembly tends to block access to some such surface, the nozzle assemblies must in any case be readily removable, that is, removable without the use of tools.

U.S. Pat. No. 3,878,856, which discloses a glass washing machine that has enjoyed commercial success, points out that a nozzle assembly consisting of plural independent tubes fitted with spray nozzles is expensive because of the attendant plumbing, and it might have added that such prior nozzle assemblies were not readily removable. That patent discloses a lower nozzle assembly comprising upper and lower pan-like members clamped together in sealed relationship to one another by means of opposite toggle arms to provide a plenum chamber, with the upper one of these members having a number of upwardly discharging nozzle outlets distributed across its top wall. This arrangement provided for easy removal of the nozzle assembly and access to the nozzles, but it was not suitable for an upper nozzle assembly having downwardly discharging outlets, and this may explain why the patent discloses only lower nozzle assemblies that discharge upwardly directed fan shaped sprays. Thus the problem of providing readily removable nozzle assemblies is complicated when each set of nozzles in a glass washing machine comprises both an upper nozzle assembly and a lower nozzle assembly and all nozzles of both assemblies must be connected with a single source of cleansing liquid.

SUMMARY OF THE INVENTION

The general object of the present invention is to provide a glass washing machine having readily removable upper and lower spray nozzle assemblies in each of its cleansing zones, and having means for so controlling liquid discharged from the nozzles in each cleansing zone as to ensure that such liquid will thoroughly wet exterior surfaces as well as interior surfaces of glasses and the like that are passed through the zone while at the same time being substantially confined to the zone in which it is discharged.

A specific object of the invention is to provide an inexpensive but long-lived spray curtain for a glass washing machine, which hangs between a pair of zones of the machine to substantially exclude from one of those zones the liquid that is discharged in sprays in the other of them, but through which glasses to be washed can nevertheless be carried from one to the other of those zones without hindrance.

In this respect, a more specific object of the invention in one of its embodiments is to provide a glass washing machine spray curtain that is conventional in comprising a sheet of supple PVC that has opposite textured surfaces and is vertically slitted to consist of numerous narrow strips, said curtain further comprising a novel and very simple and inexpensive curtain element which cooperates with that sheet to minimize friction between it and articles passing through it, prevents the strips of that sheet from being sharply flexed by such articles as they engage them, and supplements that sheet in preventing spray from passing from one to the other of the zones between which the curtain hangs, particularly at times when the strips of the sheet are deflected by articles moving through the curtain.

In another of its embodiments, the invention has the specific object of providing a glass washing machine spray curtain that is particularly suitable for disposition between two zones of the machine in which unlike liquids are normally discharged in sprays, for substantially preventing mixing of those liquids, said spray curtain being inexpensive and highly effective for its purpose, easily cleaned, and having a trouble-free useful life that is practically indefinite.

Another object of the invention is to provide very simple and inexpensive spray control means in a machine for washing beverage glasses and the like whereby cleansing liquid which is discharged upwardly from lower spray nozzles and which does not impinge glasses on a carrier above those nozzles is caused to fall back down in uniformly distributed streams that impinge external surfaces of those glasses and thus materially supplement the cleansing action of downwardly directed sprays discharged from upper spray nozzles.

Another object of the invention is to provide simple and inexpensive spray nozzle assemblies for a cleansing zone of a glass washing machine, comprising an upper nozzle assembly having downwardly discharging nozzles and a lower nozzle assembly having upwardly discharging nozzles, all of said nozzles being normally connected to receive cleansing liquid from a common source, and each nozzle assembly being quickly removable from the machine as a unit, without use of tools, to permit unrestricted access to all parts and surfaces of the machine that the nozzle assembly normally overlies or blocks.

Other objects of the invention will become apparent from the following description.

BRIEF DESCRIPTION OF THE DRAWINGS

In the accompanying drawings, which illustrate what are now regarded as preferred embodiments of the invention.

DETAILED DESCRIPTION OF PREFERRED EMBODIMENTS OF THE INVENTION

Figure 1:
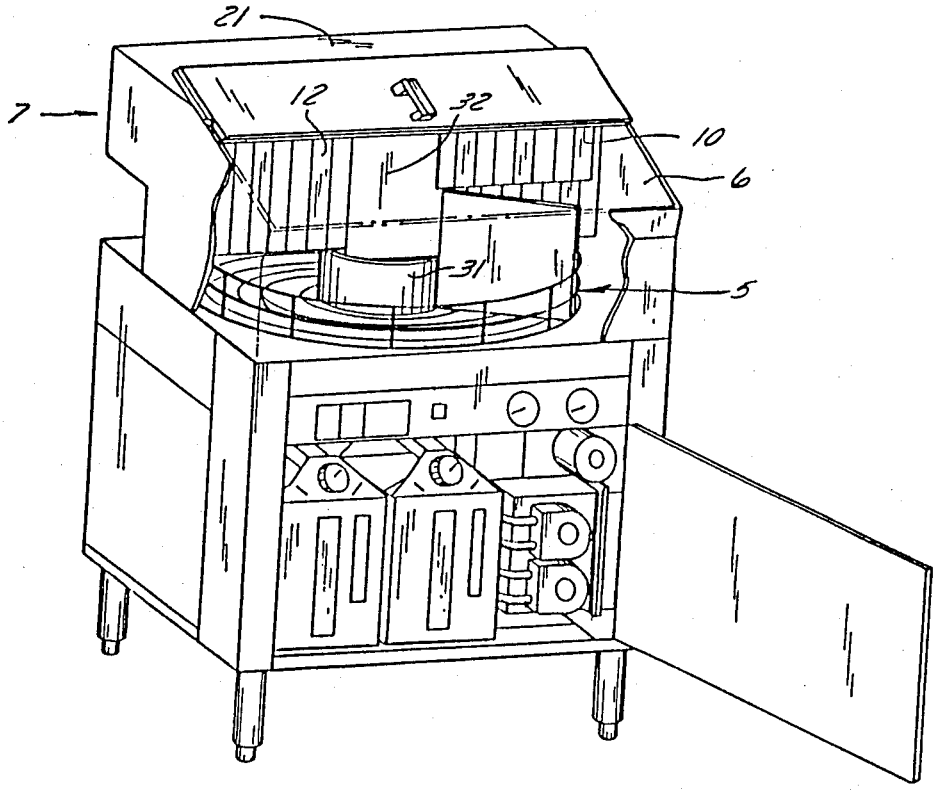
FIG. 1 is a front perspective view of a glass washing machine embodying the principles of the present invention and having a rotary carrier for articles to be washed.
Figure 2:
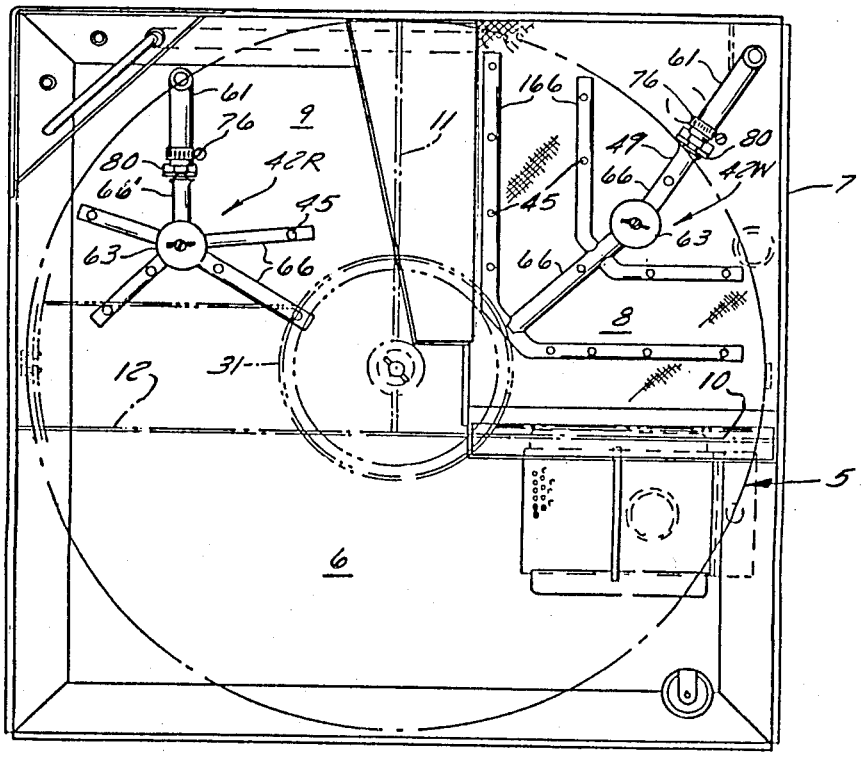
FIG. 2 is a view in horizontal section of the machine shown in FIG. 1, taken on a plane just below the carrier.

For purposes of illustration, FIG. 1 shows one of the types of glass washing machines to which the present invention is applicable. As the description proceeds, it will become apparent that the invention can, in fact, be embodied in any machine for washing beverage glasses or the like that has a carrier on which glasses to be washed are transported upside-down at a relatively slow and steady rate along either a linear or an orbital horizontal path, from an access zone at which the glasses are loaded onto the carrier, through a succession of cleansing zones in each of which the glasses are sprayed with a cleansing solution, and to the same or another access zone at which the glasses can be removed from the carrier.

The machine illustrated in FIG. 1 has a rotary carrier 5 which rotates about a vertical axis, always in one and the same direction. For each washing operation the carrier rotates through 180° while spray is continuously discharged in each cleansing zone; and then the machine stops and remains shut down until it is manually restarted. The carrier 5 is in the nature of a circular rack or shallow basket, and the machine is so arranged that one half of the carrier is always in an access zone 6 in which it can be loaded and unloaded, while its other half is in an enclosure 7 that provides two cleansing zones. The first cleansing zone 8 through which glasses are carried as the carrier rotates is a washing zone wherein the glasses are sprayed with hot detergent solution, and the second is a rinsing zone 9 wherein the glasses are sprayed with a germicidal solution. For further information about the machine, reference can be made to Ser. No. 136,133, which fully discloses its construction and operation with respect to glass washing, and to Ser. No. 145,623, which discloses its features that provide for automatic cleaning and deliming of its spray nozzles.

Spray Curtains

As glasses are transported from the access zone 6 into the washing zone 8 they pass through a first spray curtain 10 that serves to prevent detergent solution sprayed in the washing zone from entering the access zone. In moving from the washing zone 8 to the rinsing zone 9, glasses pass through a second spray curtain 11 which substantially prevents the liquid discharged in each of these zones from passing into the other. In moving back into the access zone 6 from the rinsing zone 9, glasses pass through a third spray curtain 12 which is in this case coplanar with the first curtain 10 and which substantially excludes sprayed rinsing liquid from the access zone.

Figure 3:
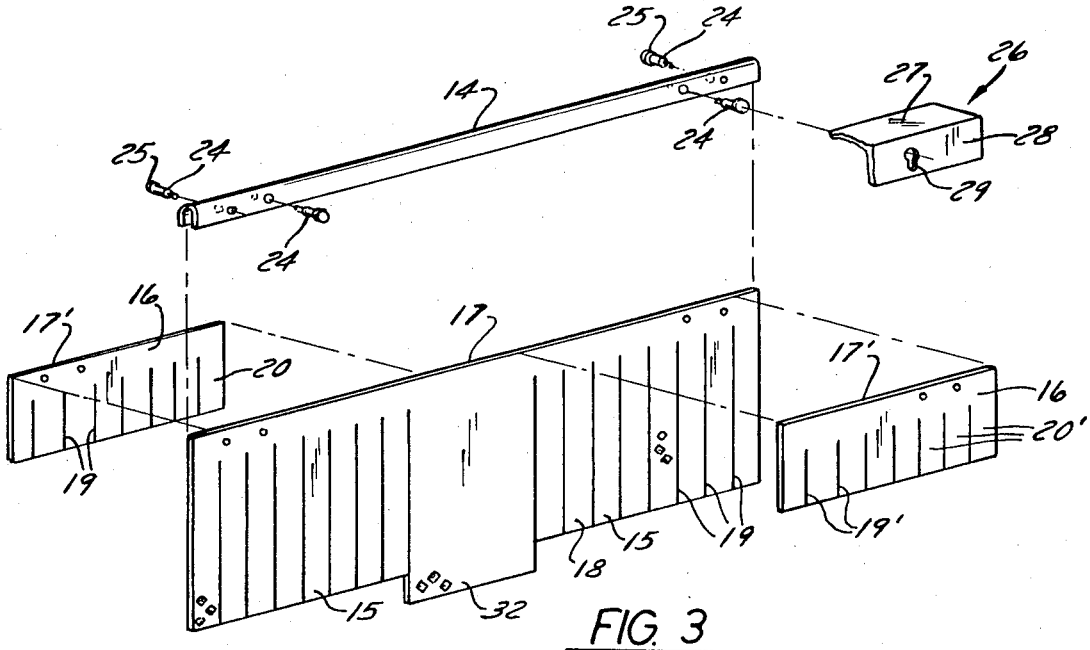
FIG. 3 is a disassembled perspective view of a spray curtain assembly for the machine shown in FIG. 1.
Figure 6:
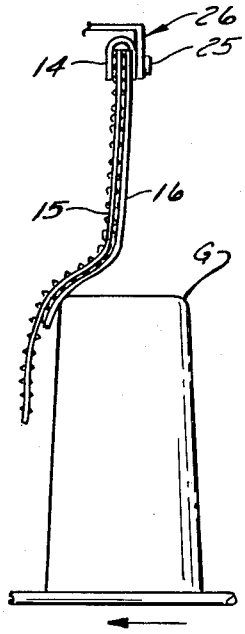
FIG. 6 is a more or less diagrammatic view, substantially in vertical section, showing how the guard sheet protects the curtain sheet during passage of a glass through the spray curtain of this invention.
Figure 4:
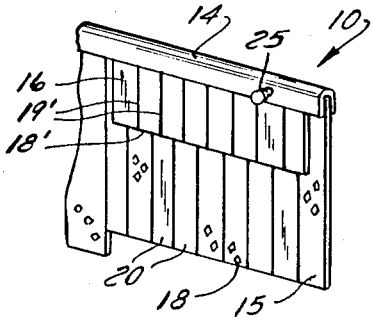
FIG. 4 is a fragmentary perspective view of a portion of the curtain shown in FIG. 3 in its assembled condition.
Figure 5:
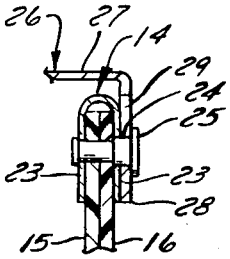
FIG. 5 is a fragmentary view in vertical section through the upper portion of the spray curtain shown in FIGS. 3 and 4.

Each of the first and third spray curtains 10 and 12 (see FIG. 3) comprises an elongated, substantially rigid, horizontally extending supporting member 14, a supple, vertically slitted curtain sheet 15, and a guard sheet 16 that flatwise overlies the curtain sheet at the surface of the latter that is engaged by glasses as they pass through the curtain. The supporting member 14 is readily detachably secured to the fixed structure of the machine as explained below and is in turn secured to the two sheets 15 and 16 along their coinciding top edges 17, 17′ to support them for hanging over the carrier 5.

The curtain sheet 15 can be of the type conventionally used for spray curtains in glass washing machines, composed of a specially formulated PVC, typically having a thickness of 0.055 inches and having opposite textured surfaces as described above. It is thus waterproof, very supple, and has a tendency to hang straight and uncurled. Uniformly spaced vertical slits 19 in this sheet 15, extending from its bottom edge 18 nearly to its top edge 17, divide it into numerous vertical strips 20, each typically 1 inch wide. Thus a glass G or the like that passes through the curtain sheet 15 engages and deflects only certain of its strips 20, leaving the remainder of it hanging straight down to provide an effective spray barrier. The supporting member 14 is installed downwardly adjacent to the top wall 21 of the enclosure 7 within which the cleansing zones 8, 9 are located, and the height of the curtain sheet 15 is such that its bottom edge 18 is spaced above the carrier 5 by a relatively small clearance distance.

The guard sheet 16 can be of low density polyethylene having a thickness of 0.020 inches and having both of its surfaces smooth. It is thus waterproof; and, while noticeably less supple than the curtain sheet, it is nevertheless quite flexible. Like the curtain sheet, the guard sheet 16 has uniformly spaced slits 19′ extending from its bottom edge 18′ nearly to its top edge 17′ and defining numerous vertical strips 20′. Preferably the slits 19′ in the guard sheet 16 are spaced apart by the same distance intervals as the slits 19 in the curtain sheet 15. The two sheets 15, 16 are so secured to the supporting member 14 as to have their slits 19, 19′ in laterally offset relation to one another, preferably by a distance equal to half the width of a strip 20 or 20′, so that each strip of one sheet overlaps two strips of the other. The height of the guard sheet 16 is substantially less than that of the curtain sheet 15—about half the height of the latter—and, therefore, since the top edges 17, 17′ of the two sheets are secured in substantially coinciding relationship, the bottom edge 18' of the guard sheet is at a substantial distance above that of the curtain sheet.

Since the guard sheet 16 overlies the surface of the curtain sheet 15 that faces the zone from which glasses approach the curtain, any glass G or the like on the carrier that is tall enough to project above the bottom edge 18' of the guard sheet initially engages the guard sheet instead of the curtain sheet. Owing to the smooth surfaces on the guard sheet, there is negligible friction between it and the advancing glass G and between it and the curtain sheet, and the guard sheet thus eliminates the rubbing action that has heretofore been one cause of short service life of the curtain sheet material. The relative stiffness of the guard sheet 16 prevents it from being sharply flexed by a glass that engages it, even if the glass has a fairly sharp corner at the junction of its side wall and bottom wall, and correspondingly the guard sheet imposes upon the curtain sheet 15 only relatively large radius flexures that have little tendency to crack the curtain sheet material after it has become somewhat embrittled by long service. Shorter glasses will, of course, pass under the guard sheet without contacting it; but since they engage only the lower portions of the curtain sheet strips, they do not impose upon those strips the high rubbing forces and sharp flexing forces that shorten the service life of the spray curtain.

The strips 20' of the guard sheet have some tendency to curl out of flatness, especially after some period of use, but such curling is of no practical consequence because the guard sheet is by no means stiff, even though it is less supple than the curtain sheet. Thus, when guard sheet strips are performing their function of protecting the curtain sheet, they are confined between it and a glass, and those two objects impose forces upon those strips that control their flexing and unflexing in accordance with the above description.

Because of the relative stiffness of the guard sheet and its tendency to curl, it will be apparent that the guard sheet should preferably not extend down along the full height of the curtain sheet but should terminate well above the bottom edge of the curtain sheet. Notwithstanding its heightwise shortness, the guard sheet tends to supplement the curtain in blocking the passage of spray, owing in some measure to the lateral overlap between the strips 20, 20' of the respective sheets.

The supporting member 14 can be made of a single strip of thin (typically 0.20 ga.) noncorroding metal, such as stainless steel, that is folded upon itself along its length to provide flatwise opposed portions 23 between which the superimposed upper margins of the two plastic sheets 15 and 16 are clampingly confined. Through these flatwise opposed portions 23 of the strip and the sheet portions between them there extend studs 24 which are spaced apart along the length of the supporting member and which maintain the metal strip in clamped relation to the plastic sheets. Each of these studs 24 projects some distance outwardly beyond one side of the supporting member, preferably in the direction away from the guard curtain, and has an enlarged head 25 on its outer end. Secured to the relatively stationary structure that defines the enclosure 7 is an L-section channel member 26, one leg 27 of which flatwise underlies the top wall 21 of that structure and the other leg 28 of which projects downwardly and is provided with keyhole-shaped apertures 29 wherein the headed studs 24 are readily removably receivable. While the keyhole-shaped apertures 29 could be formed in spaced-apart tabs or lugs secured to the top wall 21 and projecting down from it, the L-section channel 26 is preferred because it can afford reinforcement and support to the top wall 21 of the enclosure as well as to the spray curtain supporting member 14, which can engage along its length against the vertical leg 28 of that channel.

In the illustrated rotary carrier machine, the first spray curtain 10, which is between the access zone 6 and the washing zone 8, hangs in the same plane as the third spray curtain 12, which is between the rinsing zone 9 and the access zone, and the plane of those curtains is parallel to the axis of the carrier 5 and near it. These two curtains 10 and 12 can therefore be supported on a single elongated supporting member 14. A cylindrical deflector assembly 31 is coaxially seated on the carrier 5, serving, among other things, to prevent loading of glasses onto the central portion of the carrier where they would not receive adequate cleansing treatment. Over this deflector 31, between the two spray curtains, hangs a spray apron 32 which can be of the same textured PVC material as the curtain sheets 15. Since glasses do not pass through the spray apron 32, it can be unslitted and does not need a guard sheet. The spray apron can be formed in one piece with the two curtain sheets 15 of the spray curtains 10 and 12 and is, of course, secured to the same elongated supporting member 14 that supports those two spray curtains.

The spray curtains 10 and 12 as well as the spray apron 32 extend horizontally in symmetrical relation to the midpoint of the elongated supporting member 14, although the guard sheets 16 of the two curtains 10, 12 overlie opposite surfaces of their respective curtain sheets to conform to the direction of travel of glasses on the conveyor. Hence, this assembly can be turned end-for-end and can be installed in either of two orientations; and preferably the headed studs 24 on the supporting member 14 and the keyhole-shaped apertures 29 in which they are received are arranged to provide for either such installation so that the curtain assembly is reversible. Since only one side surface of each spray curtain is subjected to spray at any given time, occasional reversal of the curtain assembly will materially retard the embrittlement of the curtain sheets and correspondingly prolong their useful life.

In a machine having a carrier on which glasses are transported linearly in one direction, like that disclosed in Ser. No. 117,155, one spray curtain will normally be located at the inlet to the tunnel-like enclosure (not here shown) in which the cleansing zones are located and another one at its outlet. It will be apparent that these two spray curtains can be identical and arranged to be readily interchangeable and that interchanging them from time to time will prolong the life of both.

Figure 7:
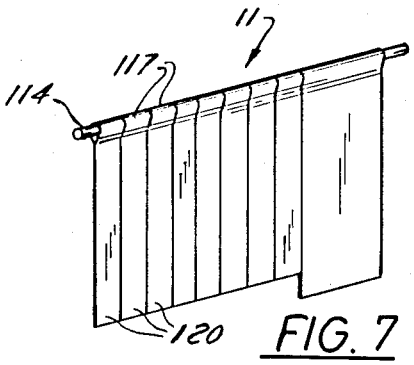
FIG. 7 is a perspective view of a modified form of spray curtain of this invention.
Figure 8:
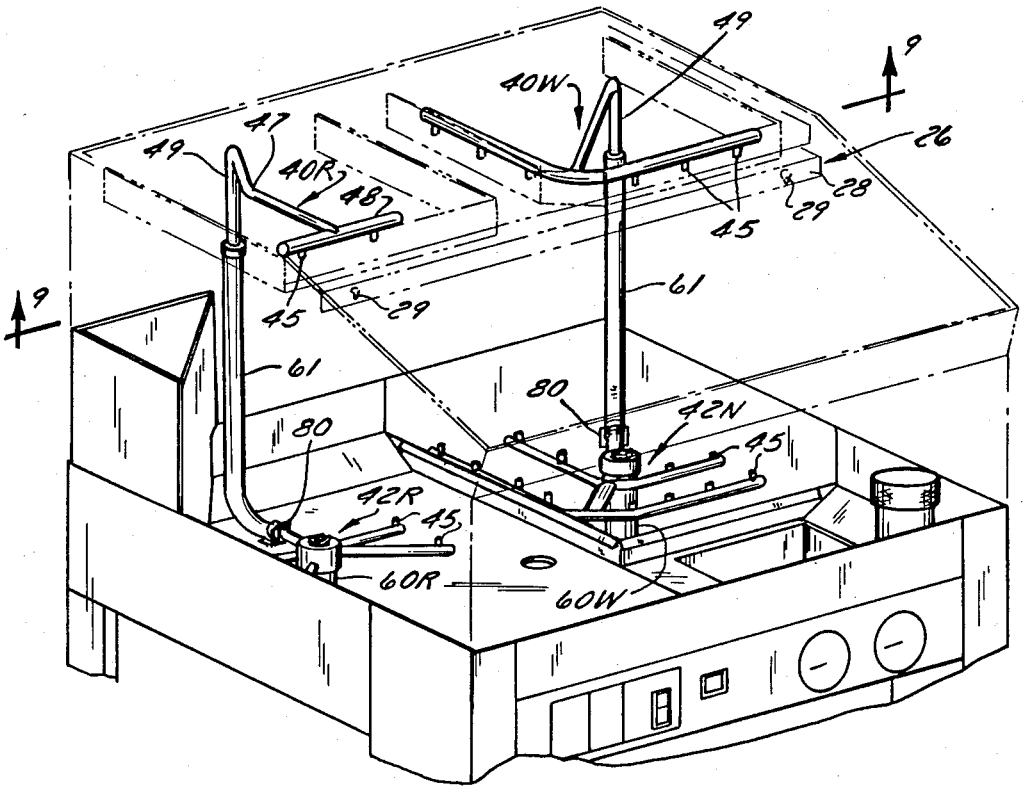
FIG. 8 is a more or less diagrammatic perspective view of the readily removable nozzle assemblies of the machine shown in FIG. 1.

In the machine here illustrated, the spray curtain 11 that hangs between the washing zone 8 and the rinsing zone 9 is not interchangeable with any other and is subjected to wetting from both zones so that reversal of it would serve no purpose. The spray curtain 11 illustrated in FIG. 7 is suitable for such a situation and has an indefinitely prolonged service life even under adverse conditions.

The supporting member 114 for the curtain 11 is a straight rod of circular cross section that is detachably supported by engagement of its end portions in suitable clips (not shown) or the like on the fixed structure. To this rod 114 are connected vertically elongated, rectangular and substantially flat strips 120 of a thin, noncorroding material, preferably light-gauge stainless steel.

Each strip 120 has an upper end edge portion 117 bent to embrace the rod 114 so that the strip is pendantly and flatwise swingably supported from the rod with its opposite flat surfaces parallel to the length of the rod. The strips 120 are of course disposed in edgewise adjacent relation to one another along the length of the rod, and they thus cooperate like the strips 20 of the above described plastic curtain sheet to provide a spray barrier. Since the strips 120 are light as well as swingable, they are readily deflectable by passing glasses. Even though the individual strips are stiff enough to remain substantially straight when engaged by a glass, the curtain as a whole has been found to be very effective in preventing liquid sprayed in each of its adjacent zones from entering the other.

Liquid Flow Control Grid

Control of spray in a glass washing machine not only requires that the liquid discharged in each cleansing zone be substantially confined to that zone but also requires that as much as possible of the liquid sprayed in each zone shall impinge the glasses in that zone to be effective in cleansing their surfaces. Of course a substantial amount of the liquid discharged upwardly from spray nozzles below the carrier inevitably passes between glasses and arrives at the top wall 21 of the enclosure 7 in which cleansing takes place. If that top wall has a substantially flat, unbroken and horizontal under surface, as has usually been the case with prior glass washing machines, most of the liquid arriving at that surface clings to it and migrates slowly across it until reaching a side wall of the enclosure, and then flows down along the inner surface of that side wall. With this flow pattern, substantially all of the upwardly discharged liquid that reaches the top wall of the enclosure is ineffectual for cleansing glasses.

Figure 9:
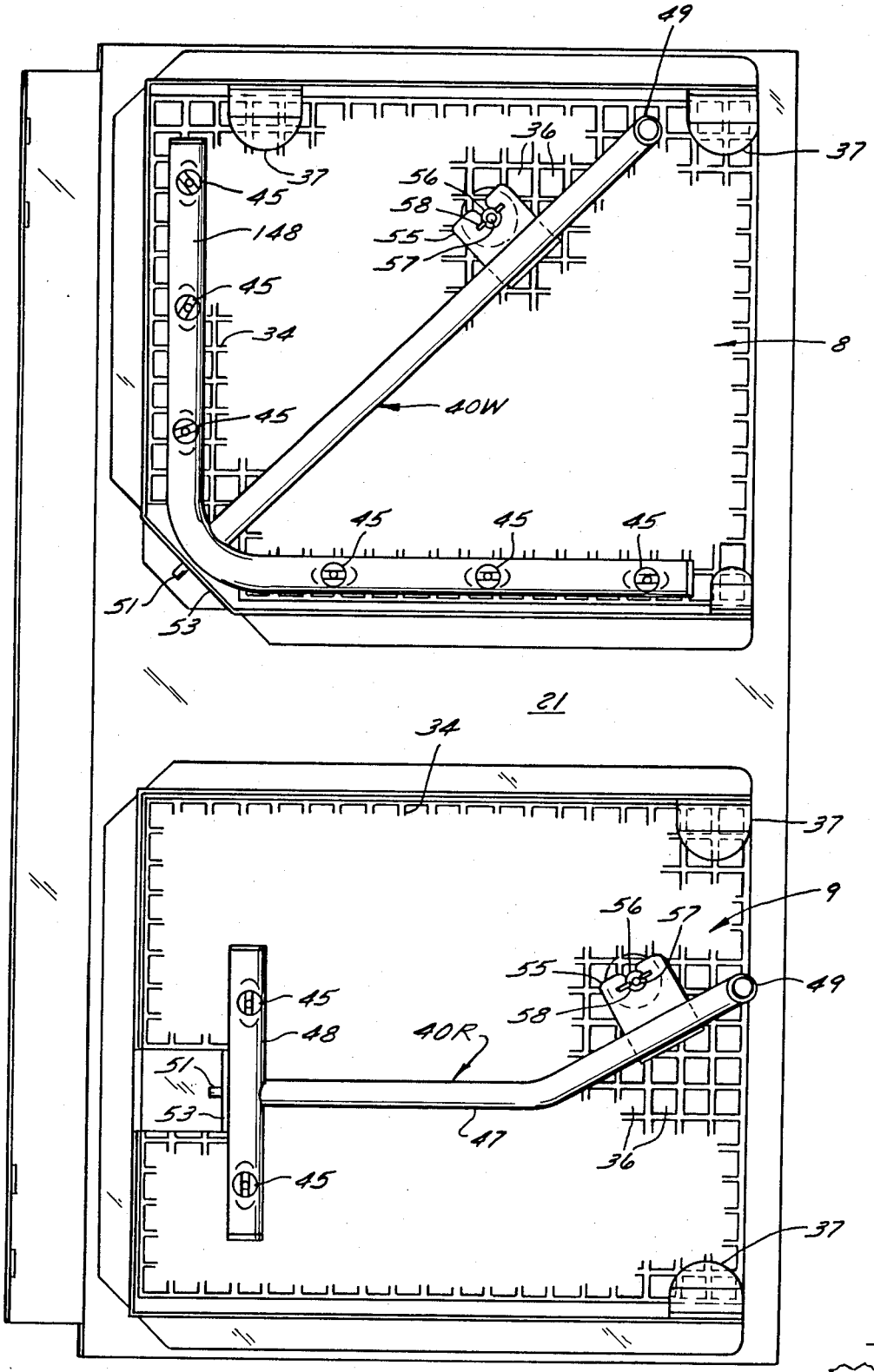
FIG. 9 is a view in horizontal section of the machine shown in FIG. 1, taken on a plane above the carrier and looking upward towards the upper nozzle assemblies and the top wall of the enclosure for the cleansing zones.
Figure 10:
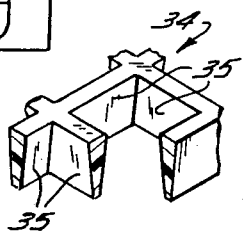
FIG. 10 is a fragmentary perspective view of the liquid flow control grid.

By contrast, FIG. 9 illustrates means for causing substantially all of the upwardly discharged liquid that reaches the top wall to fall from it in numerous streams distributed substantially uniformly across the area of the cleansing zone, so that such streams fall on all of the glasses in that zone and flow down along their exterior surfaces with a cleansing action which materially supplements that of the downwardly discharged sprays from upper nozzles. This flow control means comprises a grid 34 of rigidly interconnected slats that are edgewise engaged against the underside of the enclosure top wall 21 and define numerous and regularly spaced vertical surfaces 35 which project down from the top wall through a minor part of the distance between it and the carrier 5. This grid 34, which resembles egg-crate partitioning, can be of commercially available plastic louver material comprising thin, narrow, straight slats spaced at regular intervals of, e.g., ½ inch and intersecting one another at right angles to define a regular pattern of square holes 36. Such material is conventionally installed in vent outlets and similar openings in interior walls and cabinets. Its slats, typically of ⅜ inch depth, all taper in thickness in one direction, and it is installed in a glass washing machine with the narrow edges of these slats lowermost and their thicker edges firmly engaged against the underside of the top wall. Thus, sprayed liquid arriving at the top wall 21 of the enclosure through a hole 36 in the grid flows along the underside of the top wall for only a small distance before arriving at a slat, and then flows downwardly along the slat to fall from its bottom edge.

A grid 34 of the present invention can be secured against the top wall 21 of an enclosure in any suitable manner. As here shown, the securement means for the grid in each cleansing zone comprises a few tabs 37, each secured to the enclosure structure as by spot welding and each providing a small upwardly facing ledge on which an edge portion of the grid is supported. The tabs 37 are preferably so located and arranged as to permit the grid 34 to be slid horizontally into and out of engagement with them, so that the grid is readily removable for occasional cleaning of it and the top wall. As hereinafter explained, an upper nozzle assembly $40_W$, $40_R$ in each cleansing zone, which is also readily removable, closely underlies the grid 34 and cooperates with the tabs 37 to secure the grid against displacement.

Removable Nozzle Assemblies

In addition to the downwardly discharging upper nozzle assembly $40_W$, $40_R$, each cleansing zone 8, 9 in the machine of this invention has an upwardly discharging lower nozzle assembly $42_W$, $42_R$ beneath the carrier 5. In each cleansing zone, one type of cleansing liquid is discharged from both nozzle assemblies 40 and 42; hence, each of those assemblies must hvae a connection through which that liquid is delivered to it. For both nozzle assemblies to be readily removable, the assemblies themselves must be readily detachable from the machine and, in addition, their supply connections must be readily disconnectable to permit their removal.

Every nozzle assembly comprises a plurality of elongated tubular elements or tubes that are connected, as by weldments, to have their interiors communicated. At least one of these tubular elements has laterally opening nozzle outlets 45 at spaced intervals along its length, each defined by a cylindrical nozzle body, and one tubular element of each nozzle assembly comprises a connection portion 49 that provides for communicating the nozzle assembly with another location on the machine.

The upper rinsing nozzle assembly $40_R$ (see FIG. 9) is a particularly simple form of the nozzle assembly of this invention, comprising only two tubes 47, 48 connected in the form of a T and having only two nozzle outlets 45, one in each arm of the crossbar of the T. Along most of its length the tube 47 that defines the stem of the T is coplanar with the tube 48 that defines the crossbar of the T, so that these portions of that nozzle assembly can supportingly underlie the coplanar lower edges of the slats that comprise the grid 34 in the rinsing zone 9.

At its end portion remote from the crossbar, the tube 47 that defines the stem of the T is bent downward to comprise a vertically extending tubular element which is open at its lower end to constitute a connection tube portion 49 through which liquid enters the nozzle assembly. The ends of the crossbar tube 48 are plugged so that all liquid entering the nozzle assembly is constrained to leave it through the two nozzle outlets 45.

The upper washing nozzle assembly $40_W$ is generally like the upper rinsing nozzle assembly $40_R$. However, its crossbar tube 148 is longer and is medially bent to dispose its arms at right angles to one another, and there are several nozzle outlets 45 in each of those arms at spaced intervals along the length of it.

It will be observed that the nozzle outlets 45 in the upper nozzle assemblies $40_R$ and $40_W$ are not disposed to provide complete spray coverage across the respective zones 9 and 8 in which those assemblies are located. This is because the egg-crate grid 34 for each zone, in cooperation with the lower nozzle assembly 42 for the zone, is in substantial measure responsible for flushing the exterior surfaces of glasses, and the upper nozzle assembly for the zone mainly sprays into those portions of the zone that are not well covered by streams falling from the grid.

Each upper nozzle assembly $40_R$, $40_W$ has a small horizontal pin 51 welded to its crossbar tube 48, 148 and projecting outwardly therefrom coaxially with its stem portion to provide for support of the nozzle assembly at one point. This pin 51 is axially slidably received in a hole in a downwardly projecting lug 53 or channel flange that is secured to the top wall 21 of the enclosure 7. In addition, a simple horizontally projecting tab 55 is welded to the stem-portion tube 47 at a substantial distance from the crossbar. A slot 56 in this tab, opening to its edge remote from the tube to which it is welded, receives a threaded vertical stud 56 which has an upper end welded to the top wall 21 of the enclosure and which projects downwardly through one of the square apertures 36 in the grid. A wing nut 58 threaded onto the lower portion of the vertical stud 57 cooperates with the horizontal pin 51 to secure the nozzle assembly in place. To remove the assembly, the wing nut 58 is merely loosened, the tab 55 is disengaged from the threaded stud 57 by swinging the nozzle laterally about the horizontal pin 51 as a pivot, and then the pin 51 is slid out of its hole to free the nozzle assembly from the enclosure structure. Thus each upper nozzle assembly is supported from the stationary structure at only two points, defined by the pin 51 and the stud 57, but coplanar portions of the nozzle assembly extend substantial distances to both sides of a line connecting those points and stabilize the nozzle assembly by reason of their firm engagement against the underside of an egg-crate grid 34, which is in turn firmly engaged against the enclosure top wall 21. In this respect, the wing nut 58, in securing the nozzle assembly in place, also exerts upward clamping force on the grid 34 that confines it against the top wall.

The cleansing liquid discharged in each cleansing zone 8, 9 of the machine is delivered into the lower nozzle assembly $42_W$, $42_R$ for that zone through an upright, upwardly opening inlet duct $60_W$, $60_R$ which comprises a part of the stationary structure of the machine and to the top of which the lower nozzle assembly is readily detachably secured. A portion of the liquid entering each lower nozzle assembly $42_W$, $42_R$ from its inlet duct $60_W$, $60_R$ is discharged through the upwardly opening nozzle outlets 45 of that assembly; the remainder of that liquid is conducted to the cooperating upper nozzle assembly $40_W$, $40_R$, in each case by means of a flexible hose 61 that has male fittings 62 on its opposite ends which are readily detachably connectible to the respective upper and lower nozzle assemblies.

Figure 11:
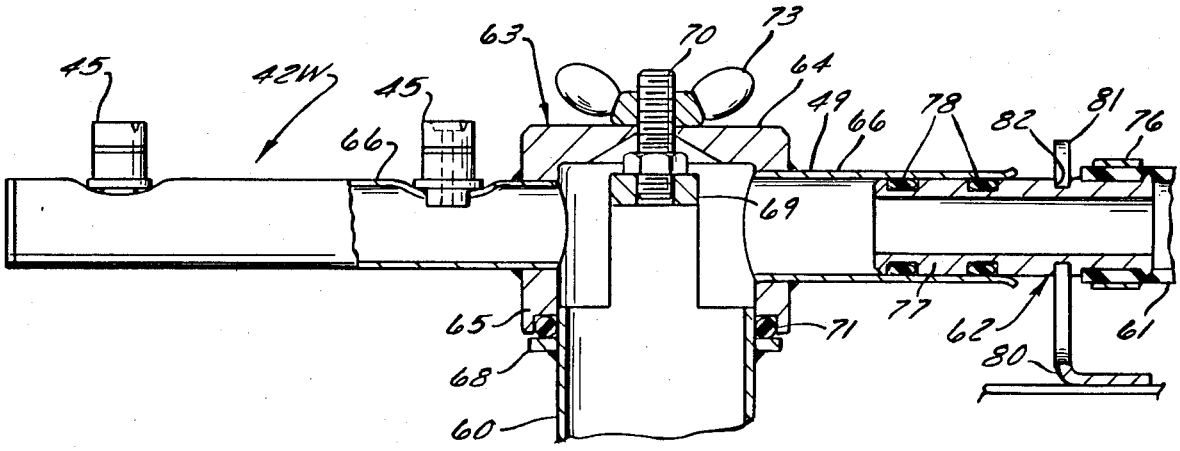
FIG. 11 is a view of the lower washing nozzle assembly and its inlet duct and outlet connections, partly in side elevation but mainly in vertical section.
Figure 12:
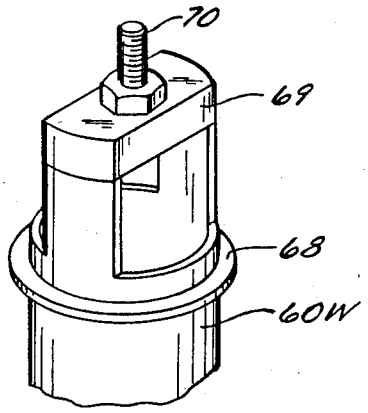
FIG. 12 is a fragmentary perspective view of the upper end portion of the inlet duct shown in FIG. 11.
Figure 13:
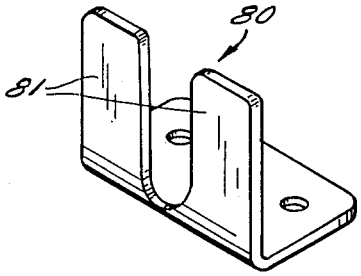
FIG. 13 is a perspective view of the hose fitting clip of the structure shown in FIG. 11.

Each of the lower nozzle assemblies $42_W$, $42_R$ comprises an inverted cup-shaped hub 63 (see FIG. 11) by which the nozzle assemble is secured to its inlet duct $60_W$, $60_R$. This hub has an end wall 64 wherein there is a concentric aperture and has a cylindrical side wall 65 that extends downward from the end wall. To the side wall 65 of the hub are secured radially projecting tubular elements 66 that have their radially inner ends open to the interior of the hub.

In the case of the lower rinsing nozzle assembly $42_R$ there are several such radial tubular elements 66 in which there are upwardly opening nozzle outlets 45 at lengthwise spaced intervals, each outlet defined by a cylindrical nozzle body. With one exception each of the tubuler elements 66 has its outer end plugged. The tubular element 66' that is open at its radially outer end constitutes a connection tube portion 49 in which a hose fitting 62 is received.

The lower washing nozzle assembly $42_W$ has, in this case, only two tubular elements 66 that are secured to its inlet hub 63 and project from it in substantially opposite radial directions, one of them relatively short and open at its outer end to comprise a connection tube portion 49 that receives a hose fitting 62, the other relatively long and connected with a pair of transverse tubes 166 which are plugged at their outer ends and in which there are upwardly opening, spaced apart nozzle outlets 45, each defined by a cylindrical nozzle body.

The inlet duct $60_W$, $60_R$ for each lower nozzle assembly is a metal tube with an outside diameter to be closely receivable in its hub 63. Secured to each inlet duct as by welding, at a small distance below its upper outlet end, is a washer 68 that provides a radially outwardly projecting circumferential sealing flange around it. Secured inside the outlet end portion of the duct is a spider-like member 69 that supports a coaxial, axially outwardly projecting threaded stud 70 that is receivable in the hole in the end wall 64 of the hub. The outlet end portion of the duct has notches or holes through which liquid can pass around the spider 69 and into the tubular elements 66 that are connected with the hub. In the rim portion of the hub side wall 65 there is a circumferential, radially inwardly opening recess in which is seated an O-ring 71. A wing nut 72 on the threaded stud 70 secures the hub onto the end portion of its duct, clampwise confining the O-ring 71 under axial sealing compression against the washer 68 and thereby also establishing the O-ring in radial sealing confinement between the duct and the hub. It will be apparent that each lower nozzle assembly can be removed from its inlet duct in a few seconds by removing the wing nut 72 that secures its hub 63 and lifting the nozzle assembly off of its inlet duct.

Each of the hose fittings 62 that provides for readily detachable connection between a hose 61 and a nozzle assembly comprises an elongated and sturdy tubular piece having an axially inner end portion 75 to which an end portion of the hose 61 is secured by means of a hose clamp 76 and having a coaxial outer end portion 77 which projects beyond the hose and which has two axially spaced circumferential grooves around its exterior wherein O-rings 78 are seated. The O-rings 78 are dimensioned to provide the axially outer end portion 77 of the fitting with a fairly snug push fit in the connection tube portion 49 of a nozzle assembly, and each such tube portion 49 preferably has a slightly flared mouth to facilitate axial insertion of the fitting.

For every nozzle assembly there is a sheet metal hose fitting clip 80 that is bent to an L shape to have one leg secured as by welding to fixed structure of the machine. The other leg of this clip projects across the axis of the connection tube portion 49 of the nozzle assembly, in axially outwardly spaced relation to that tube portion, and is bifurcated by a lengthwise extending slot that opens to its free end and defines parallel tongues 81 between which the hose fitting 62 for the nozzle assembly is received. The medial portion of the hose fitting has as circumferential groove 82 in its exterior surface, adjacent to the front end of the hose, wherein the tongues 81 of the clip are received with a close fit to confine the fitting against axial displacement and thus prevent it from backing out of its nozzle assembly.

For installation of a lower nozzle assembly, the appropriate hose fitting 62 is pushed into the connection tube portion 49 of that assembly and is then engaged with the tongues 81 of its clip 80 while the hub 63 of the nozzle assembly is fitted to its inlet duct $60_W$, $60_R$. The wing nut 72 is turned onto the threaded stud 70, which projects up through the end wall 64 of the hub, and is tightened to seal the hub to the inlet duct and complete the installation. Note that the clip 80, in its cooperation with the hose fitting, establishes the orientation of the nozzle assembly with respect to its rotation about the inlet duct as well as maintaining the connection between the hose fitting and the nozzle assembly. Before an upper nozzle assembly is installed, the appropriate hose fitting 62 is pushed into the connection tube portion 49 of that assembly and is engaged with its cooperating clip 80 as the assembly is brought into its installed position.

Since every nozzle assembly is essentially secured in place by a single wing nut 58 or 72, any nozzle assembly can be installed or removed in a few seconds and without the use of any tools.

From the foregoing description taken with the accompanying drawings, it will be apparent that this invention provides improved spray control means for a glass washing machine, and, in particular, provides very effective and inexpensive spray control curtains that are more durable than those heretofore available, simple and inexpensive means for converting upwardly discharged sprays from lower spray nozzles into uniformly distributed falling streams that are effective for cleansing the exterior surfaces of glasses, and spray nozzle assemblies that can be quickly removed and installed without the use of tools.

What is claimed as the invention is:

1. A machine for washing articles such as beverage glasses, comprising a carrier for supporting articles to be washed, housing structure defining an enclosure that has a top wall with a substantially horizontal undersurface overlying the carrier at a substantial distance above the same, and nozzles mounted beneath the carrier from which liquid is discharged upwardly through the carrier towards an area of said top wall, said machine being characterized by:

a grid of slats which have upper edges engaged against the underside of said top wall and which project edgewise down from it through a minor part of said distance and are spaced apart at substantially regular intervals across said area to define numerous vertical surfaces whereby liquid that has been discharged from said nozzles and has impinged the top wall is guided for fall therefrom in substantially uniformly distributed streams.

2. The machine of claim 1, further comprising an upper nozzle assembly mounted above said carrier and beneath said top wall and having outlets from which liquid is discharged downwardly, further characterized by:

(a) the slats of said grid being interconnected in fixed relation to one another; and (b) fastening means on said housing structure for removably supporting said upper nozzle assembly in underlying relation to the grid and with portions of that nozzle assembly engaging lower edges of a plurality of said slats to confine the grid in engagement with said top wall.

3. The machine of claim 2 wherein said fastening means comprises:

(1) a threaded stud fixed to said top wall and projecting down from it between slats of the grid, (2) a horizontally projecting tab on the upper nozzle assembly that has an aperture in it through which said stud extends, and (3) a nut threaded onto said stud and supportingly underlying said tab.

* * * * *